US010690389B2

(12) United States Patent
Dube

(10) Patent No.: US 10,690,389 B2
(45) Date of Patent: Jun. 23, 2020

(54) $CO_2$ REFRIGERATION SYSTEM

(71) Applicant: Serge Dube, St-Zotique (CA)

(72) Inventor: Serge Dube, St-Zotique (CA)

(73) Assignee: TOROMONT INDUSTRIES LTD, Concord (CA)

( * ) Notice: Subject to any disclaimer, the term of this patent is extended or adjusted under 35 U.S.C. 154(b) by 746 days.

(21) Appl. No.: 14/831,170

(22) Filed: Aug. 20, 2015

(65) Prior Publication Data

US 2015/0354882 A1 Dec. 10, 2015

Related U.S. Application Data

(63) Continuation of application No. 13/124,894, filed as application No. PCT/CA2009/001536 on Oct. 23, 2009, now abandoned.

(Continued)

(51) Int. Cl.
*F25C 3/02* (2006.01)
*F25B 31/00* (2006.01)

(Continued)

(52) U.S. Cl.
CPC ..... *F25C 3/02* (2013.01); *F24F 3/1417* (2013.01); *F25B 5/02* (2013.01); *F25B 9/008* (2013.01);

(Continued)

(58) Field of Classification Search
CPC .. F25B 29/003; F25B 5/02; F25B 7/00; F25B 31/00; F25B 31/004
See application file for complete search history.

(56) References Cited

U.S. PATENT DOCUMENTS 336,952 A 3/1886 Schmitz
508,755 A 11/1893 Rankin
(Continued)

FOREIGN PATENT DOCUMENTS

CA 2199929 A1 * 9/1998 ..... F25B 6/00
EP 1921399 A3 3/2010
(Continued)

OTHER PUBLICATIONS

"Ice Rink Refrigeration System with Carbon Dioxide as Secondary Fluid in Copper Tubes".

(Continued)

*Primary Examiner* — Jianying C Atkisson
*Assistant Examiner* — Jose O Class-Quinones
(74) *Attorney, Agent, or Firm* — Norton Rose Fulbright Canada LLP

(57) ABSTRACT

A $CO_2$ refrigeration system for an ice-playing surface comprises an evaporation stage in which heat is absorbed from an ice-playing surface. $CO_2$ compressors in a compression stage compress $CO_2$ refrigerant subcritically and transcritically. A gas cooling stage has a plurality of heat-reclaim units reclaiming heat from the $CO_2$ refrigerant. A pressure-regulating device is downstream of the gas cooling stage, to control a pressure of the $CO_2$ refrigerant in the gas cooling stage. A reservoir is downstream of the pressure-regulating device for receiving $CO_2$ refrigerant in a liquid state. A controller operates the pressure-regulating device to control the pressure of the $CO_2$ refrigerant in the gas cooling stage as a function of the heat demand of the plurality of heat-reclaim units, the controller causing the pressure of the $CO_2$ refrigerant to reach a transcritical level as a function of a heat demand of the plurality of heat-reclaim units.

16 Claims, 13 Drawing Sheets

Related U.S. Application Data

(60) Provisional application No. 61/107,689, filed on Oct. 23, 2008, provisional application No. 61/166,884, filed on Apr. 6, 2009, provisional application No. 61/184,021, filed on Jun. 4, 2009.

(51) Int. Cl.

| | |
|---|---|
| ***F25B 5/02*** | (2006.01) |
| ***F25B 9/00*** | (2006.01) |
| ***F25B 29/00*** | (2006.01) |
| ***F24F 3/14*** | (2006.01) |

(52) U.S. Cl.

CPC ..... *F25B 29/003* (2013.01); *F25B 31/00* (2013.01); *F25B 31/004* (2013.01); *F24F 2003/144* (2013.01); *F25B 2309/06* (2013.01); *F25B 2309/061* (2013.01)

(56) References Cited

U.S. PATENT DOCUMENTS

| | | | | |
|---|---|---|---|---|
| 577,323 | A | 2/1897 | Singer | |
| 2,069,811 | A | 2/1937 | Baer et al. | |
| 2,371,396 | A | 3/1945 | Knowles | |
| 2,797,552 | A | 7/1957 | LaCart | |
| 2,966,043 | A | 12/1960 | Hirota | |
| 3,307,372 | A | 3/1967 | Kenison | |
| 3,485,057 | A | 12/1969 | Etter et al. | |
| 3,831,394 | A | 8/1974 | Holmsten | |
| 4,319,462 | A | 3/1982 | Foster | |
| 4,414,821 | A | 11/1983 | Jing | |
| 4,841,739 | A | 6/1989 | Wallner | |
| 5,245,836 | A | 9/1993 | Lorentzen et al. | |
| 5,319,945 | A | 6/1994 | Bartlett | |
| 5,365,748 | A | 11/1994 | Li | |
| 5,575,159 | A | 11/1996 | Dittell | |
| 6,058,727 | A * | 5/2000 | Fraser, Jr. ..... | F25B 31/002 62/190 |
| 6,089,033 | A | 7/2000 | Dubé | |
| 6,216,481 | B1 | 4/2001 | Kantchev | |
| 6,263,694 | B1 * | 7/2001 | Boyko ..... | F25B 31/004 62/195 |
| 6,321,551 | B1 | 11/2001 | Backman et al. | |
| 6,385,980 | B1 * | 5/2002 | Sienel ..... | F25B 5/04 62/174 |
| 6,457,325 | B1 * | 10/2002 | Vetter ..... | F25B 31/004 62/473 |
| 6,502,412 | B1 | 1/2003 | Dube | |
| 6,796,139 | B2 | 9/2004 | Briley et al. | |
| 7,032,398 | B2 | 4/2006 | Dilk et al. | |
| 7,310,960 | B2 | 12/2007 | Sienel et al. | |
| 7,669,428 | B2 | 3/2010 | Fedorov | |
| 7,716,943 | B2 | 5/2010 | Seefeldt | |
| 7,781,006 | B2 | 8/2010 | Brisson et al. | |
| 7,845,190 | B2 | 12/2010 | Pearson | |
| 7,891,201 | B1 | 2/2011 | Bush et al. | |
| 8,113,008 | B2 | 2/2012 | Heinbokel et al. | |
| 8,316,654 | B2 | 11/2012 | Heinbokel et al. | |
| 2004/0103681 | A1 | 6/2004 | Aflekt et al. | |
| 2004/0261449 | A1 * | 12/2004 | Memory ..... | F25B 40/00 62/513 |
| 2005/0279127 | A1 | 12/2005 | Jia et al. | |
| 2006/0130494 | A1 | 6/2006 | Dube | |
| 2008/0184715 | A1 | 8/2008 | Chen et al. | |
| 2009/0019878 | A1 | 1/2009 | Gupte | |
| 2009/0120108 | A1 | 5/2009 | Heinbokel et al. | |
| 2009/0277203 | A1 * | 11/2009 | Dupraz ..... | F24D 3/08 62/238.7 |

FOREIGN PATENT DOCUMENTS

| | | | |
|---|---|---|---|
| GB | 2453515 | A | 4/2009 |
| WO | 2006087005 | A1 | 8/2006 |
| WO | 2006087011 | A1 | 8/2006 |
| WO | 2006091190 | A1 | 8/2006 |
| WO | 2007022777 | A1 | 3/2007 |
| WO | 2007022778 | A1 | 3/2007 |
| WO | 2008019689 | A3 | 4/2008 |
| WO | 2008112554 | A1 | 9/2008 |
| WO | 2008146071 | A1 | 12/2008 |

OTHER PUBLICATIONS

"An Ice Rink Refrigeration System based on CO2 as Secondary Fluid in Copper Tubes".
"Customised Industrial Refrigeration Firmly Established at Cofely".
Article by Rehnby, M. (2004), "Koldioxid i Butikskylsystem" from ScanRef Magazine, 33(4).
"Natural Refrigerant CO2".
"Carbon Dioxide in Supermarket Refrigeration".
"Effect of Internal Heat Exchanger on Performance of Transcritical CO2 Systems with Ejector".
"The Performance of a Transcritical CO2 Cycle with an Internal Heat Exchanger for Hot Water Heating".
Thesis "Combined Air-conditioning and Tap Water Heating Plant, Using CO2 as Refrigerant for Indonesian Climate Condition".
English translation of Japanese Patent Application No. 2001-241785A "CO2 Refrigerant Heat Pump and Snow Melting Device".
Application guide / "Industrial Refrigeration Valves for CO2 applications".
"Copper tubing developed for ice rink installations".
"Referenzliste für CO2 Kunsteinsbahnen von 1999-2004".
"CO2—A Refrigerant from the past with prospects of being one of the main refrigerants in the future".
"Theoretical evaluation of trans-critical CO2 systems in supermarket refrigeration. Part I : Modeling, simulation and optimization of two system solutions".
Procurement document and the Opening Protocol of Jan. 12, 2006.
Drawing from Industri & Laboratoriekyl.
Preissuance Submission, entered Dec. 24, 2014, pp. 35.
Technical Guidelines of an Ice Rink, International Ice Hockey Federation, Chapter 3, pp. 25, web.archive.org/web/20071204132122/http://www.iihf.com/iihf-home/sport/arena-manual.html.
Ted Martin "Evolution of Ice Rinks", 100 Years of Refrigeration—A Supplement to ASHRAE Journal, Nov. 2004, pp. 524-530.
Williams S. Bodinus "The Rise and Fall of Carbon Dioxide Systems" ASHRAE Journal, Apr. 1999, pp. 37-42.
Kim et al., "Fundamental process and system design issues in C02 vapour compression systems", Elsevier Science, Progress in Energy and Combustion Science, vol. 30 (2004) pp. 119-174, at pp. 120-123 and 160.
GB 1901-No.9084 of Windhausen et al., issued Apr. 24, 1902.
Northwest Tech-Con Systems Ltd., "Application for Patent of Multi-Level Liquid Probe NTS3400T", Jun. 1, 2011, abstract.
http://www.r744.com/knowledge/papersView/high_efficient_heat_reclaim_with_co2 Kenneth Bank Madsen, Application Manager, Danfoss A/S, Denmark, "High efficient heat reclaim with CO2".
"First CO2 Refrigeration System for Medium-and Low-Temperature Refrigeration at Swiss Megastore".
"Evolution of ice rinks".
Axima Information sheet.
Compilation of CO2 ice rinks.
"Ice Rink Refrigeration System with CO2 as Secondary Fluid".
"Natural Working Fluids in Artificial Skating Rinks".
Industri & Laboratoriekyl proposal handed in as a side tender during the Katrineholm Ice rink procurement in Jan. 2006.
Call for tenders and the design proposed by Green & Cool.
Article in Ashrae Journal in Mar. 2012 entitled "Ice Rink Uses CO2 System".
IIHF Arena manual.
Canadian Patent 2,599,769 (Mayekawa).
Drawing of a direct ammonia system (Stal Refrigeration, Sweden 1976) and drawing of an indirect system from 2003 for the Älta rink.
Article entitled "CO2 in Refrigeration Application".
International Patent Application No. WO2006/087011 "CO2 Refrigeration Device with Heat Reclaim".

(56) References Cited

OTHER PUBLICATIONS

English translation of Japanese Patent Application No. 2006-292229A "CO2 Refrigeration Cycle Device and Supercritical Refrigeration Operation Method Thereof".
English translation of Japanese Patent Application No. 2004-339741A "Super-Critical CO2 Refrigerant Snow Melting System".
Refrigeration circuit of the IGA of Granby.
English translation of Japanese Patent Application No. 2009-36415A "Heat Pump Cycle System Using Geo-Heat".
"Energy Analysis of Backavallen Ice Rink Refrigeration System with CO2 as Heat Transfer Liquid in Copper Tubes".
Jeff Staub, 'CO2 As Refrigerant: The Transcritical Cycle' Jan. 26, 2004, Air Conditioning, Heating and Refrigeration News, http://www.achrnews.com/articles/print/co2-as-refrigerant-the-transcritical-cycle.
PCT application No. PCT/CA2009/001536, International Search Report and Written Opinion, dated Feb. 2, 2010, 9 pages.
Danfoss, "Refrigeration—an introduction to the basics".
Accent Refrigeration Systems Ltd., "Energy efficiency for recreational ice facilities".
2010 ASHRAE Handbook—Refrigeration, Chapter 44.
Ice Kube Systems Ltd, "Geothermal Ice Arenas".
William & Bodinus, "The rise and fall of carbon dioxide systems".
Danfoss, "CO2 Refrigerant for Industrial Refrigeration", Parts I & II.
"Revival of carbon dioxide as a refrigerant".
"Development of Improved Secondary Refrigerants".
"CO2 and NH3 in the supermarket".

* cited by examiner

$CO_2$ REFRIGERATION SYSTEM

CROSS-REFERENCE TO RELATED APPLICATION

The present application is a continuation of U.S. patent application Ser. No. 13/124,894, which is a national phase entry of PCT/CA09/01536, filed on Oct. 23, 2008, which claims priority on U.S. Patent Application No. 61/107,689, filed on Oct. 23, 2008, No. 61/166,884, filed on Apr. 6, 2009, and No. 61/184,021, filed on Jun. 4, 2009.

FIELD OF THE APPLICATION

The present application relates to refrigeration systems, and more particularly to refrigeration systems using $CO_2$ refrigerant.

BACKGROUND OF THE ART

With the growing concern for global warming, the use of chlorofluorocarbons (CFCs) and hydrochlorofluorocarbons (HCFCs) as refrigerant has been identified as having a negative impact on the environment. These chemicals have non-negligible ozone-depletion potential and/or global-warming potential.

As alternatives to CFCs and HCFCs, ammonia, hydrocarbons and $CO_2$ are used as refrigerants. Although ammonia and hydrocarbons have negligible ozone-depletion potential and global-warming potential as does $CO_2$, these refrigerants are highly flammable and therefore represent a risk to local safety. On the other hand, $CO_2$ is environmentally benign and locally safe.

SUMMARY OF THE APPLICATION

It is therefore an aim of the present disclosure to provide a $CO_2$ refrigeration system that addresses issues associated with the prior art.

Therefore, in accordance with a first embodiment of the present application, there is provided a $CO_2$ refrigeration system for an ice-playing surface, comprising: a supra-compression portion comprising a supra-compression stage in which $CO_2$ refrigerant is supra-compressed and a cooling stage in which the supra-compressed $CO_2$ refrigerant releases heat; a condensation reservoir accumulating a portion of the $CO_2$ refrigerant in a liquid state; pressure-regulating means between the supra-compression portion and the condensation reservoir to control a pressure of the supra-compressed $CO_2$ refrigerant being directed to the condensation reservoir; and an evaporation stage receiving the $CO_2$ refrigerant from the condensation reservoir, the evaporation stage having a circuit of pipes arranged under the ice-playing surface, whereby the $CO_2$ refrigerant circulating in the circuit of pipes of the evaporation stage absorbs heat from the ice-playing surface.

Further in accordance with the first embodiment, the system further comprises a secondary refrigerant circuit in which circulates a secondary refrigerant, and wherein the supra-compression portion comprises at least one heat reclaim exchanger related to the secondary refrigerant circuit, the at least one heat reclaim exchanger causing the supra-compressed $CO_2$ refrigerant to release heat to the secondary refrigerant.

Still further in accordance with the first embodiment, the heat reclaim exchanger and the gas cooling stage are in at least one of a parallel arrangement, and a series arrangement.

Still further in accordance with the first embodiment, the system further comprises at least one water tank in the secondary refrigerant circuit, with the at least one water tank comprising a heat exchanger in which circulates the secondary refrigerant to heat water in the water tank.

Still further in accordance with the first embodiment, the secondary refrigerant circuit further comprises at least one water tank, with the at least one water tank comprising a heat exchanger in which circulates the $CO_2$ refrigerant to heat water in the water tank.

Still further in accordance with the first embodiment, the secondary refrigerant circuit comprises at least one melting heat exchanger in an ice dump, the melting heat exchanger receiving secondary refrigerant to release heat to zamboni residue in the ice dump.

Still further in accordance with the first embodiment, the system further comprises a suction line extending from a top of the condensation reservoir to an inlet of the supra-compression stage, with a valve in said suction line, such that gaseous $CO_2$ refrigerant in the condensation reservoir is directed to the supra-compression stage.

Still further in accordance with the first embodiment, the system further comprises a heat exchanger in said suction line for heat exchange between the gaseous $CO_2$ refrigerant and $CO_2$ refrigerant exiting the cooling stage.

Still further in accordance with the first embodiment, the system comprises a pressure-controlling unit in said suction line to control a pressure differential between the condensation reservoir and the supra-compression stage.

Still further in accordance with the first embodiment, the system further comprises an expansion stage between the condensation reservoir and the evaporation stage to vaporize the $CO_2$ refrigerant fed to the circuit of pipes.

Still further in accordance with the first embodiment, the system further comprises at least one pump between the condensation reservoir and the evaporation stage to induce a flow of $CO_2$ refrigerant to the evaporation stage.

Still further in accordance with the first embodiment, the supra-compression stage compresses the $CO_2$ refrigerant to a transcritical state.

In accordance with a second embodiment of the present application, there is provided a $CO_2$ refrigeration system for an ice-playing surface, comprising: a $CO_2$ refrigerant circuit comprising a condensation reservoir accumulating a portion of the $CO_2$ refrigerant in a liquid state, and an evaporation stage receiving the $CO_2$ refrigerant from the condensation reservoir, the evaporation stage having a circuit of pipes arranged under the ice-playing surface, whereby the $CO_2$ refrigerant circulating in the circuit of pipes of the evaporation stage absorbs heat from the ice-playing surface; an independent refrigerant circuit in heat-exchange relation with the $CO_2$ refrigerant of the $CO_2$ refrigerant circuit, the independent refrigerant circuit comprising a compression stage with at least one magnetically-operated compressor to compress a secondary refrigerant, a condensation stage in which the secondary refrigerant releases heat, and an evaporation stage in which the secondary refrigerant is in heat exchange relation with the $CO_2$ refrigerant circuit by a heat exchanger to absorb heat therefrom.

Further in accordance with the second embodiment, the system further comprises a line extending from a top of the condensation reservoir to the heat exchanger, such that gaseous $CO_2$ refrigerant in the condensation reservoir is directed to the independent refrigerant circuit.

Still further in accordance with the present disclosure, there is provided a $CO_2$ refrigeration system for an ice-playing surface, comprising: a compression portion comprising: a compression stage comprising at least one compressor in which $CO_2$ refrigerant is compressed to a transcritical state; a gas cooling stage in which the $CO_2$ refrigerant compressed to the transcritical state releases heat by heat exchange with a gas; pressure-regulating means downstream of the gas cooling stage to control a pressure of the $CO_2$ refrigerant in the compression portion of the $CO_2$ refrigeration system; and an oil circuit in the $CO_2$ refrigeration system, the oil circuit collecting oil downstream of the at least one compressor in the compression stage, the oil circuit directing the oil upstream of the at least one compressor for the $CO_2$ refrigerant fed to the compressor to have an oil content.

DESCRIPTION OF PREFERRED EMBODIMENTS

Figure 1:
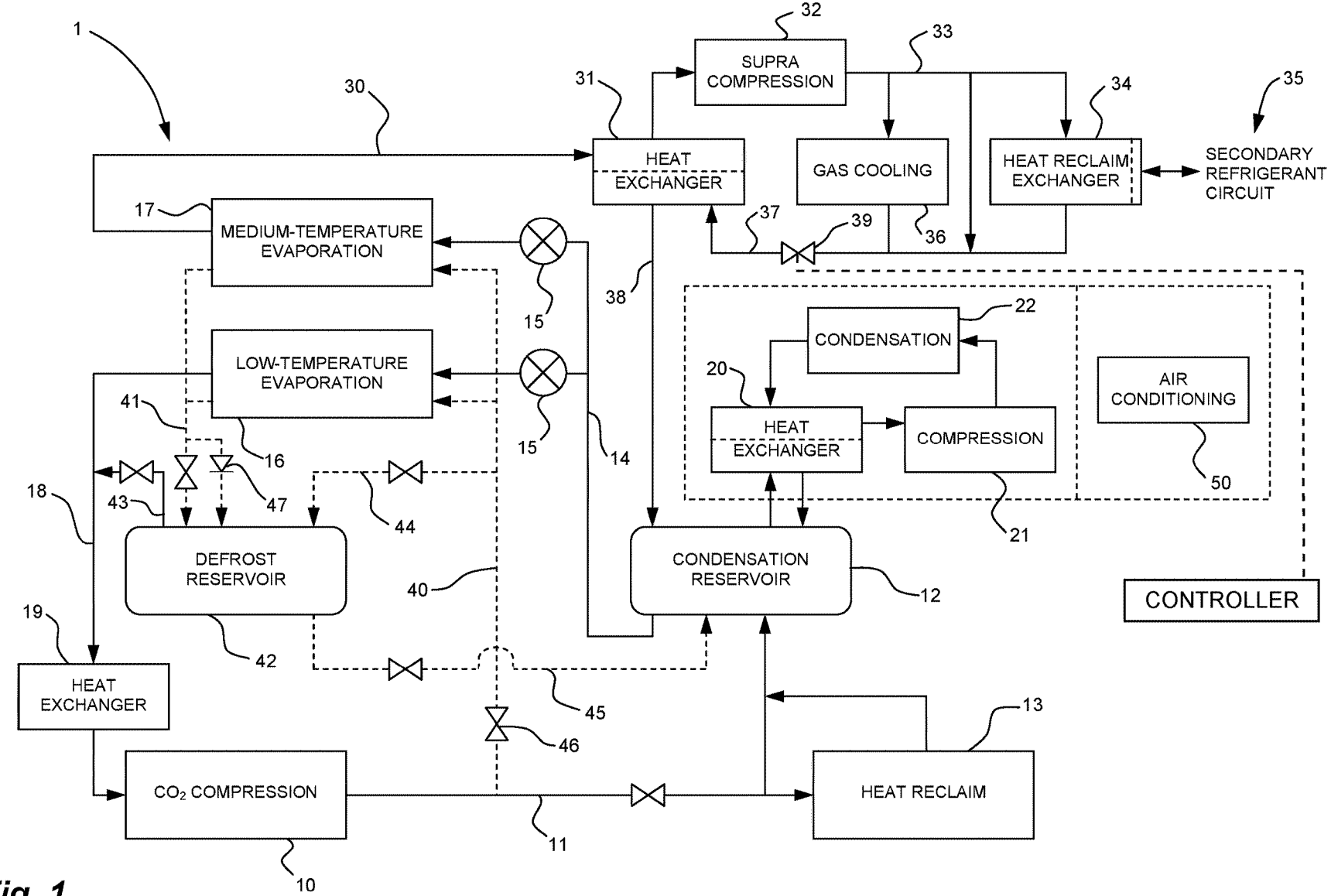
FIG. 1 is a block diagram of a $CO_2$ refrigeration system in accordance with an embodiment of the present application.

Referring to FIG. 1, a $CO_2$ refrigeration system in accordance with an embodiment is illustrated at 1. The $CO_2$ refrigeration system 1 has a $CO_2$ refrigeration circuit comprising a $CO_2$ compression stage 10. $CO_2$ refrigerant is compressed in the compression stage 10, and is subsequently directed via line 11 to a condensation reservoir 12, or to a heat-reclaim stage 13.

The condensation reservoir 12 accumulates $CO_2$ refrigerant in a liquid and gaseous state, and is in a heat-exchange relation with a condensation circuit that absorbs heat from the $CO_2$ refrigerant. The condensation circuit is described in further detail hereinafter. Moreover, a transcritical circuit and a defrost circuit may supply $CO_2$ refrigerant to the condensation reservoir 12, as is described in further detail hereinafter.

The heat-reclaim stage 13 is provided to absorb heat from the $CO_2$ refrigerant exiting from the compression stage 10. The heat-reclaim stage 13 may take various forms, such as that of a heat exchanger by which the $CO_2$ refrigerant is in heat exchange with an alcohol-based refrigerant circulating in a closed loop. As another example, the heat-reclaim stage 13 features coils by which the $CO_2$ refrigerant releases heat to a water tank.

Line 14 directs $CO_2$ refrigerant from the condensation reservoir 12 to an evaporation stage via expansion valves 15. As is shown in FIG. 1, the $CO_2$ refrigerant is supplied in a liquid state by the condensation reservoir 12 into line 14. The expansion valves 15 control the pressure of the $CO_2$ refrigerant, which is then fed to either low-temperature evaporation stage 16 or medium-temperature evaporation stage 17. Both the evaporation stages 16 and 17 feature evaporators associated with refrigerated enclosures, such as closed or opened refrigerators, freezers or the like. It is pointed out that the expansion valves 15 may be part of a refrigeration pack in the mechanical room, as opposed to being at the refrigeration cabinets. As a result, flexible lines (e.g., plastic non-rigid lines) could extend from the expansion valves 15 to diffuser upstream of the coils of the evaporation stages 16 and 17. The valves 15 may be at the refrigeration cabinets, at the refrigeration pack in a mechanical room, or any other suitable location.

$CO_2$ refrigerant exiting the low-temperature evaporation stage 16 is directed to the $CO_2$ compression stage 10 via line 18 to complete a refrigeration cycle. A heat exchanger 19 is provided in the line 18, and ensures that the $CO_2$ refrigerant is fed to the compression stage 10 in a gaseous state. Other components, such as a liquid accumulator, may be used as an alternative to the heat exchanger 19. As described hereinafter, the heat exchanger 19 may be associated with a condensation circuit.

$CO_2$ refrigerant exiting the medium-temperature evaporation stage 17 is directed to the transcritical circuit as is described hereinafter.

A condensation circuit has a heat exchanger 20. The heat exchanger 20 is in fluid communication with the condensation reservoir 12, so as to receive $CO_2$ refrigerant in a gaseous state. The condensation circuit is closed and comprises a condensation refrigerant that also circulates in the heat exchanger 20 so as to absorb heat from the $CO_2$ refrigerant.

In the condensation circuit, the condensation refrigerant circulates between the heat exchanger 20 in which the condensation refrigerant absorbs heat, a compression stage 21 in which the condensation refrigerant is compressed, and a condensation stage 22 in which the condensation refrigerant releases heat. The compression stage 21 may use Turbocor™ compressors. In an example, the condensation stage 22 features heat reclaiming (e.g., using a heat exchanger with a heat-transfer fluid) in parallel or in series with other components of the condensation stage 22, so as to reclaim heat from the $CO_2$ refrigerant. Although not shown, the condensation circuit may be used in conjunction with the heat exchanger 19, so as to absorb heat from the $CO_2$ refrigerant being directed to the compression stage 10. In this case, the condensation refrigerant is in a heat-exchange relation with the $CO_2$ refrigerant.

It is pointed out that the condensation circuit may be used with more than one $CO_2$ refrigeration circuit. In such a case, the condensation circuit features a plurality of heat exchangers 20, for instance with one for each of the $CO_2$ refrigeration circuits.

Examples of the condensation refrigerant are refrigerants such as R-404 and R-507, amongst numerous examples. It is observed that the condensation circuit may be confined to its own casing as illustrated in FIG. 1. Moreover, considering that the condensation circuit is preferably limited to absorbing heat from stages on a refrigeration pack (e.g., condensation reservoir 12, suction header in line 18), the condensation circuit does not contain a large volume of refrigerant when compared to the $CO_2$ refrigeration circuit, of a secondary refrigerant circuit defined hereinafter.

The transcritical circuit (i.e., supra-compression circuit) is provided to compress the $CO_2$ refrigerant exiting from the medium-temperature evaporation stage 17 to a transcritical state, for heating purposes, or supra-compressed state. In both compression states, the $CO_2$ refrigerant is pressurized in view of maintaining the condensation reservoir 12 at a high enough pressure to allow vaporized $CO_2$ refrigerant to be circulated in the evaporation stages 16 and 17, as opposed to liquid $CO_2$ refrigerant.

A line 30 relates the medium-temperature evaporation stage 17 to a heat exchanger 31 and subsequently to a supra-compression stage 32. The heat exchanger 31 is provided to vaporize the $CO_2$ refrigerant fed to the transcritical compression stage 32. The supra-compression stage 32 features one or more compressors (e.g., Bock™, Dorin™), that compress the $CO_2$ refrigerant to a supra-compressed or transcritical state.

In the transcritical state, the $CO_2$ refrigerant is used to heat a secondary refrigerant via heat-reclaim exchanger 34. In the heat-reclaim exchanger 34, the $CO_2$ refrigerant is in a heat-exchange relation with the secondary refrigerant circulating in the secondary refrigerant circuit 35. The secondary refrigerant is preferably an environmentally-sound refrigerant, such as water or glycol, that is used as a heat-transfer fluid. Because of the transcritical state of the $CO_2$ refrigerant, the secondary refrigerant circulating in the circuit 35 reaches a high temperature. Accordingly, due to the high temperature of the secondary refrigerant, lines of smaller diameter may be used for the secondary refrigerant circuit 35. It is pointed out that the secondary refrigerant circuit 35 is the largest of the circuits of the refrigeration system 1 in terms of quantity of refrigerant. Therefore, the compression of the $CO_2$ refrigerant into a transcritical state by the transcritical circuit allows the lines of the secondary refrigerant circuit 35 to be reduced in terms of diameter.

A gas cooling stage 36 is provided in the transcritical circuit. The gas cooling stage 36 absorbs excess heat from the $CO_2$ refrigerant in the transcritical state, in view of re-injecting the $CO_2$ refrigerant in the condensation reservoir 12. Although it is illustrated in a parallel relation with the heat-reclaim exchanger 34, the gas cooling stage 36 may be in series therewith, or in any other suitable arrangement. Although not shown, appropriate valves are provided so as to control the amount of $CO_2$ refrigerant directed to the gas cooling stage 36, in view of the heat demand from the heat-reclaim exchanger 34.

In warmer climates in which the demand for heat is smaller, the $CO_2$ refrigerant is compressed to a supra-compressed state, namely at a high enough pressure to allow the expansion of the $CO_2$ refrigerant at the exit of the condensation reservoir 12, so as to reduce the amount of $CO_2$ refrigerant circulating in the refrigeration circuit. A by-pass line is provided to illustrate that the heat-reclaim exchanger 24 and the gas cooling stage 36 are optional for warmer climates.

The gas cooling stage 36 may feature a fan blowing a gas refrigerant on coils. The speed of the fan may be controlled as a function of the heat demand of the heat reclaim exchanger 34. For an increased speed of the fan, there results an increase in the temperature differential at opposite ends of the gas cooling stage 36.

Lines 37 and 38 return the $CO_2$ refrigerant to the condensation reservoir 12, and thus to the refrigeration circuit. The line 37 feeds the heat exchanger 31 such that the $CO_2$ refrigerant exiting the stages 34 and 36 release heat to the $CO_2$ refrigerant fed to the supra-compression stage 32. Accordingly, the $CO_2$ refrigerant fed to the supra-compression stage 32 is in a gaseous state.

In the case of transcritical compression, a $CO_2$ transcritical pressure-regulating valve 39 is provided to maintain appropriate pressures at the stages 34 and 36, and in the condensation reservoir 12. The $CO_2$ transcritical pressure-regulating valve 39 is for instance a Danfoss™ valve. Any other suitable pressure-control device may be used as an alternative to the valve 39, such as any type of valve or loop.

The condensation circuit and the supra-compression circuit allow the condensation reservoir 12 to store refrigerant at a relatively medium pressure. Accordingly, no pump may be required to induce the flow of refrigerant from the condensation reservoir 12 to the evaporation stages 16 and 17. As $CO_2$ refrigerant is vaporized downstream of the expansion valves 15, the amount of $CO_2$ refrigerant in the refrigeration circuit is reduced, especially if the expansion valves 15 are in the refrigeration pack.

It is considered to operate the supra-compression circuit (i.e., supra compression 32) with higher operating pressure. $CO_2$ refrigerant has a suitable efficiency at a higher pressure. More specifically, more heat can be extracted when the pressure is higher.

The refrigeration system 1 may be provided with a refrigerant defrost system. In FIG. 1, a portion of the $CO_2$ refrigerant exiting from the compression stage 10 is directed to the evaporation stages 16 and 17. Although not shown, appropriate valves and pressure-reducing devices are provided to stop the flow of cooling $CO_2$ refrigerant in the evaporators in view of the defrost. The defrost $CO_2$ refrigerant releases heat to defrost any frost build-up on the evaporators of the evaporation stages 16 and/or 17.

Although not shown, other compression configurations may be used to supply defrost refrigerant to the evaporators, such as dedicated compressors, cascaded compressors of the like.

Line 41 directs the defrost $CO_2$ refrigerant having released heat to the defrost reservoir 42. The defrost reservoir 42 accumulates the defrost $CO_2$ refrigerant, and features a line 43 with a control valve (e.g., exhaust valve, check valve), so as to allow gaseous $CO_2$ refrigerant to be sucked back into the $CO_2$ refrigeration circuit by the $CO_2$ compression stage 10. The defrost reservoir 42 is an option, as the evaporation stages 16 and 17 may direct the refrigerant to other reservoirs or accumulators of any other refrigeration system presenter herein.

A flush of the defrost reservoir 42 may be performed periodically, so as to empty the defrost reservoir 42. Accordingly, lines 44 and 45, with appropriate valves, allow the flush of the liquid $CO_2$ refrigerant from the defrost reservoir 42 to the condensation reservoir 12.

A pressure-reducing valve 46 may be provided in the line 40 or line 11 to regulate a pressure of the defrost $CO_2$ refrigerant fed to the evaporation stage 16 and/or 17 for defrost. Valves, such as check valve 47, are as relief valves for the evaporation stages 16 and 17. For instance, in case of a power shortage, the $CO_2$ refrigerant in the evaporators may increase in pressure. Accordingly, the check valves 47 open at a threshold pressure to allow the $CO_2$ refrigerant to reach the defrost reservoir 42.

Considering that the compressors of the $CO_2$ compression stage 10 or of the compression stage 21 are low-consumption compressors, these compressors may be operated during a power outage to maintain suitable refrigerating conditions in the evaporation stages 16 and 17. The compressors of the compression stage 21 may also be Turbocor™ compressors.

As an alternative to the defrost circuit, the evaporators of the evaporation stages 16 and 17 may be equipped with electric coils for the electric defrost of the evaporators.

In an embodiment, the casing enclosing the condensation circuit may also comprise an air-conditioning unit 50. Accordingly, the roof-top equipment associated with the refrigeration system 1 is provided in a single casing, thereby facilitating the installation thereof. Moreover, it is considered to unite as many components of the refrigeration system 1 in a single refrigeration pack. For instance, the compressors of the $CO_2$ compression stage 10, the condensation reservoir 12, the expansion valves 15, and optionally the compressors from the supra-compression stage 32, as well as the defrost reservoir 42 may all be provided in a same pack, with most of the lines joining these components. The installation is therefore simplified by such a configuration.

Figure 2:
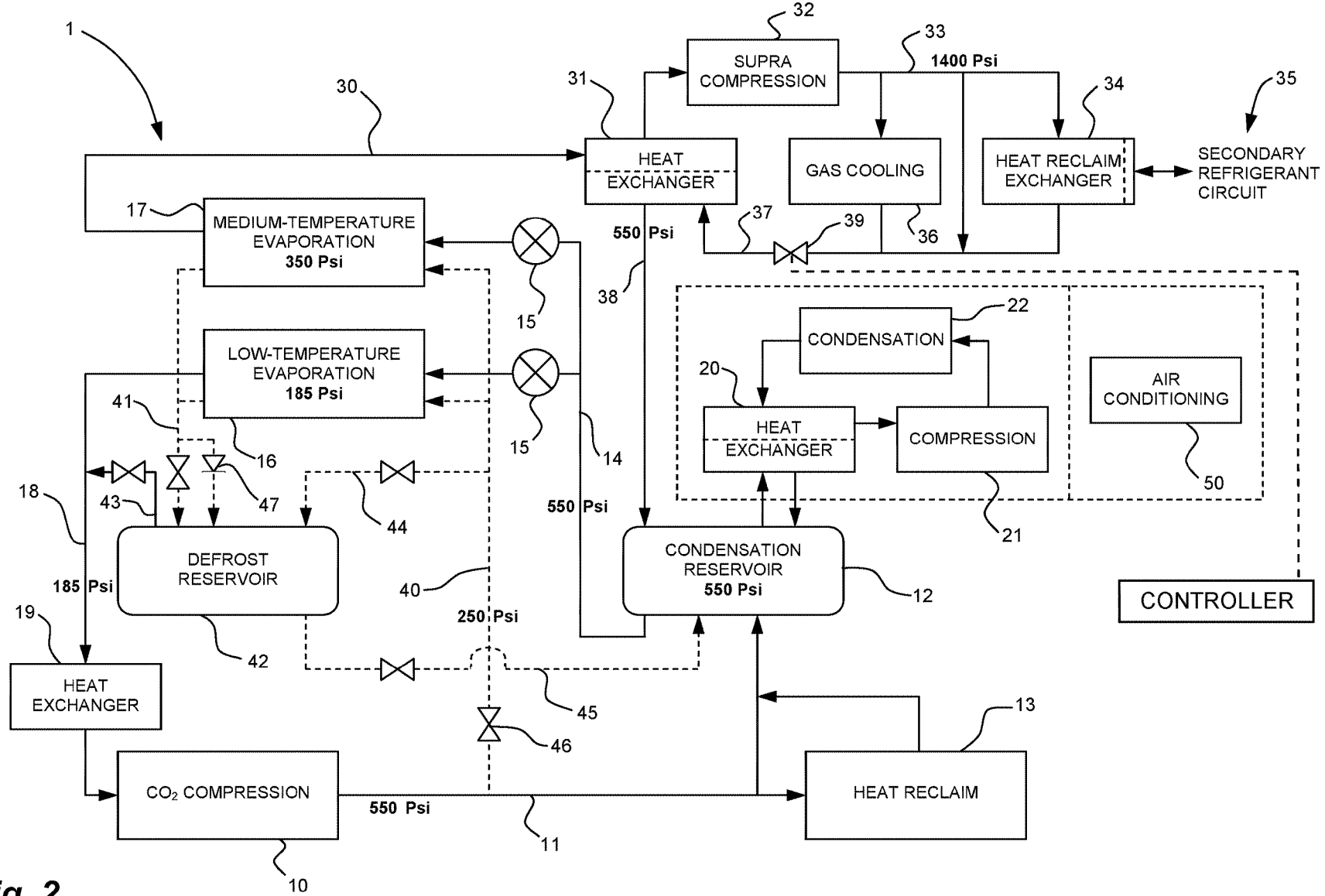
FIG. 2 is a block diagram of the $CO_2$ refrigeration system of FIG. 1, with an example of operating pressures for a cold climate application.
Figure 3:
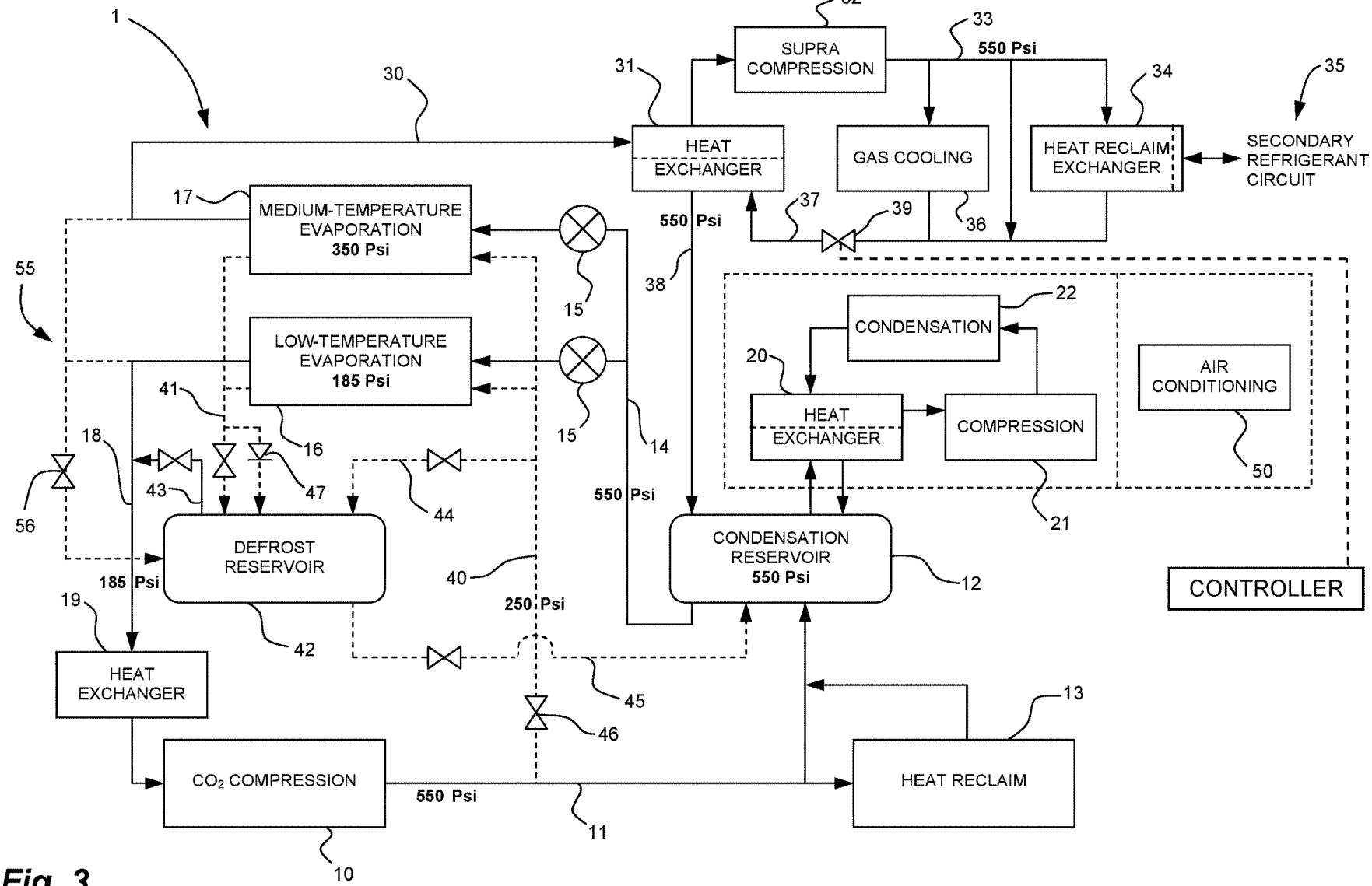
FIG. 3 is a block diagram of the $CO_2$ refrigeration system of FIG. 1, with an example of operating pressures for a warm climate application.

In order to illustrate the operating pressures of the $CO_2$ refrigeration system 1 in cold and warm climates, FIGS. 2 and 3 are respectively provided with pressure values. It is pointed out that all values are just an illustration, whereby pressure values could be higher or lower. FIG. 2 shows operating pressures for the $CO_2$ refrigeration system 1 as used in cold climates (e.g., winter conditions in colder regions), with a demand for heat by the secondary refrigerant circuit 35. FIG. 3 shows operating pressures for the $CO_2$ refrigeration system as used in warm climates (e.g., summer conditions, warmer regions).

Although not fully illustrated, numerous valves are provided to control the operation of the $CO_2$ refrigeration system 1 as described above. Moreover, a controller ensures that the various stages of the refrigeration system 1 operate as described, for instance by having a plurality of sensors places throughout the refrigeration system 1.

Referring to FIG. 3, there is illustrated a safety valve circuit 55 so as to ensure that the refrigerant pressure in the coils of the evaporation stages 16 and 17 does not exceed a given maximum value (e.g., 410 Psi), which may result in damages to the coils. The safety valve circuits 55 extends from the evaporation stages 16 and 17 (e.g., lines at the exit of the coils) to the defrost reservoir 42. A safety valve 56 is provided in the circuit, and operates by monitoring the pressure in the coils and opening as a result of the pressure reaching the maximum value. The defrost reservoir 42 then absorbs the excess pressure by receiving the refrigerant. The defrost reservoir 42 subsequently discharges the refrigerant using the lines described previously.

Figure 4:
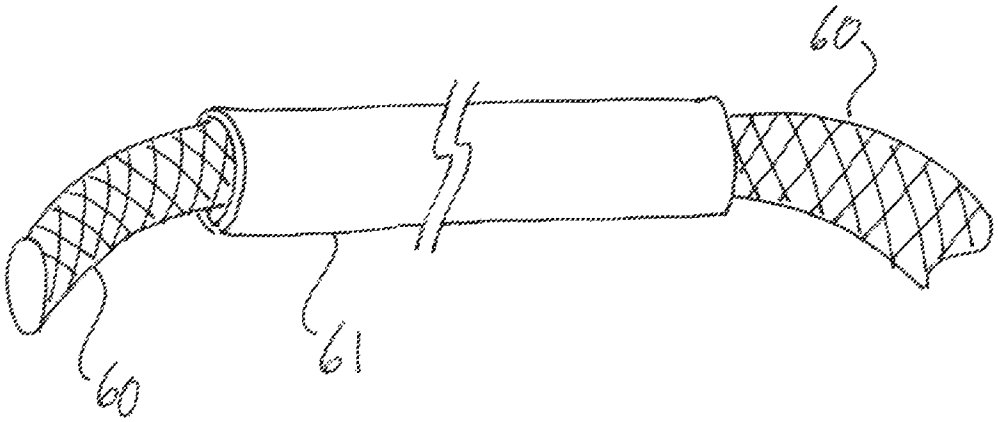
FIG. 4 is a schematic view of a line used with the $CO_2$ refrigeration system, in accordance with another embodiment of the present application.

Referring to FIG. 4, a line that may be used in the $CO_2$ refrigeration system 1 is illustrated at 60. The line 60 is a flexible hose adapted to support the relatively high pressures associated with $CO_2$ refrigerant. One suitable example of flexible hose is the "Transfer Oil" hydraulic hose by Gomax™. The hose 60 is rodded into a conduit of sleeves 61 of an insulating material, such as urethane, positioned end to end to cover the length of hose 60. A plurality of hoses 60 may be used with a single sleeve 61, provided the inner diameter of the sleeve 61 is large enough to receive the hoses 60. Therefore, by the use of flexible hoses, the installation of the lines is simplified. Previous lines required welding operation to join tubes of metallic material.

Figure 5:
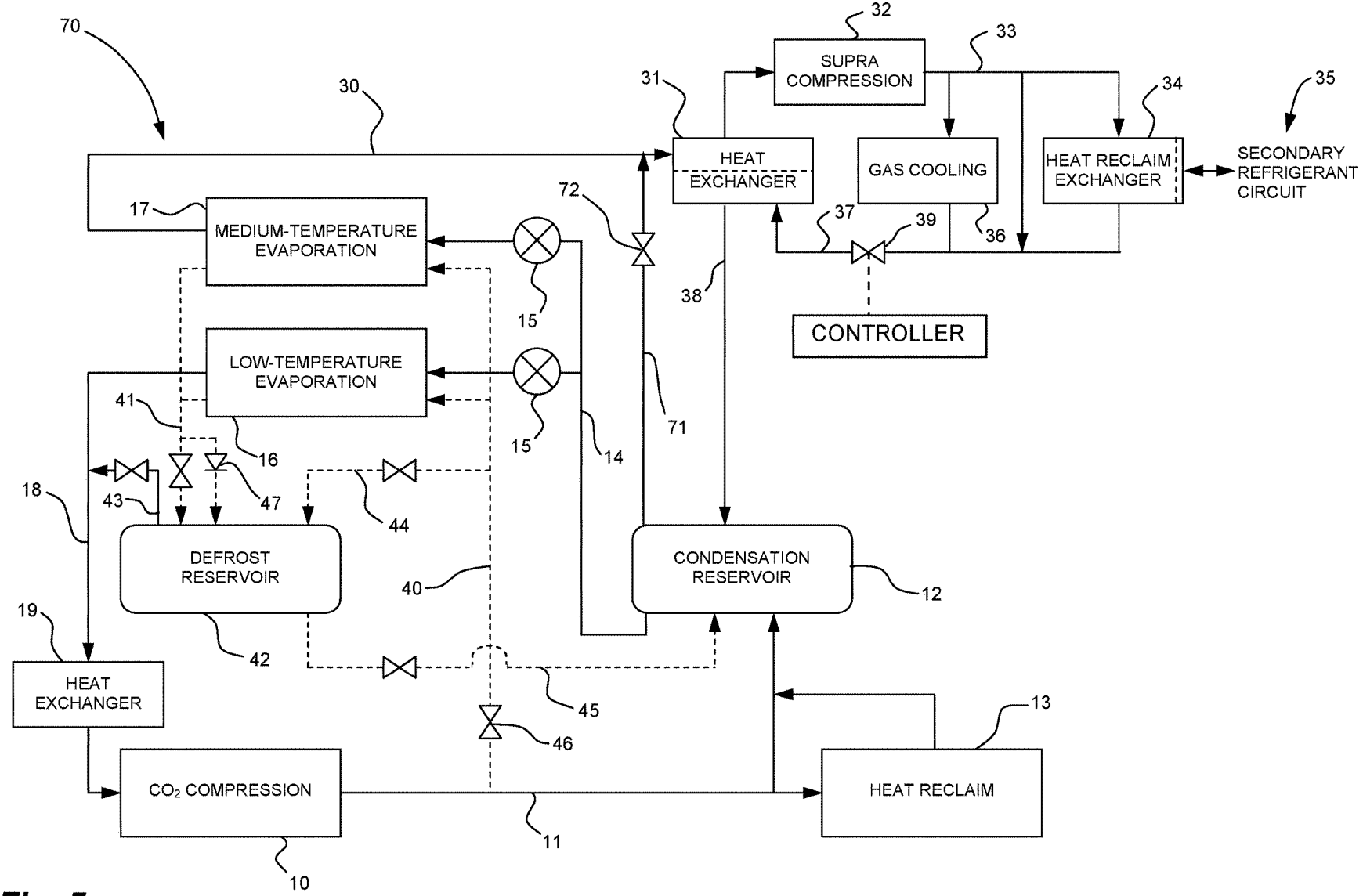
FIG. 5 is a block diagram of a $CO_2$ refrigeration system in accordance with another embodiment.

Referring to FIG. 5, an alternative embodiment of the $CO_2$ refrigeration system 1 of FIGS. 1-3 is illustrated at 70. The $CO_2$ refrigeration systems 1 and 70 have numerous common stages and lines, whereby like elements will bear like reference numerals. One difference between the $CO_2$ refrigeration systems 1 and 70 is the absence of a condensation circuit such as the one having the heat exchanger 20 in FIGS. 1-3. Rather, the $CO_2$ refrigerant in the condensation reservoir 12 is cooled by the transcritical circuit (i.e., supra-compression circuit) featuring the heat exchanger 31.

Therefore, a line 71 extends from the condensation reservoir 12 and directs $CO_2$ refrigerant to the hot side of the heat exchanger 31, which heat exchanger 31 is optional and is used to vaporize the $CO_2$ refrigerant if necessary. The line 71 may be collecting gas $CO_2$ refrigerant at a top of the condensation reservoir 12 to direct the $CO_2$ refrigerant to the heat exchanger 31. A pressure-reducing valve 72 is provided in line 71 to ensure that the $CO_2$ refrigerant reaches the heat exchanger 31 at a suitable pressure. The $CO_2$ refrigerant goes through the supra-compression circuit in the manner described previously, so as to lose heat, and return to the condensation reservoir 12 primarily in a liquid state.

It is pointed out that the configuration of the $CO_2$ refrigeration system 70 of FIG. 5 is such that a single refrigerant, namely $CO_2$ refrigerant, is used therein.

Figure 6:
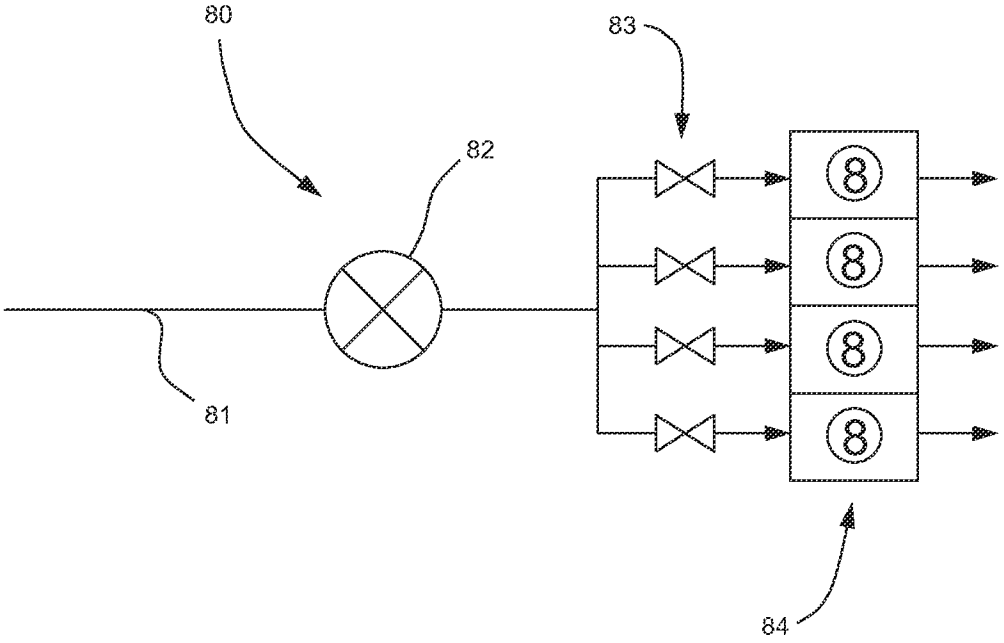
FIG. 6 is a schematic view of a line configuration for a refrigeration unit, in accordance with yet another embodiment of the present application.

Referring to FIG. 6, an alternative line configuration is shown at 80, which line configuration is typically used to supply refrigerant to large refrigeration units (e.g., in freezer rooms). Line 81, typically a large diameter line, diverges into a plurality of smaller lines, from an expansion valve 82. Each smaller line may have a valve 83, and each feeds an own smaller refrigeration unit 84. As a result, some of the units 84 may be turned off, so as to meet more precisely the cool demand of an enclosure.

Figure 7:
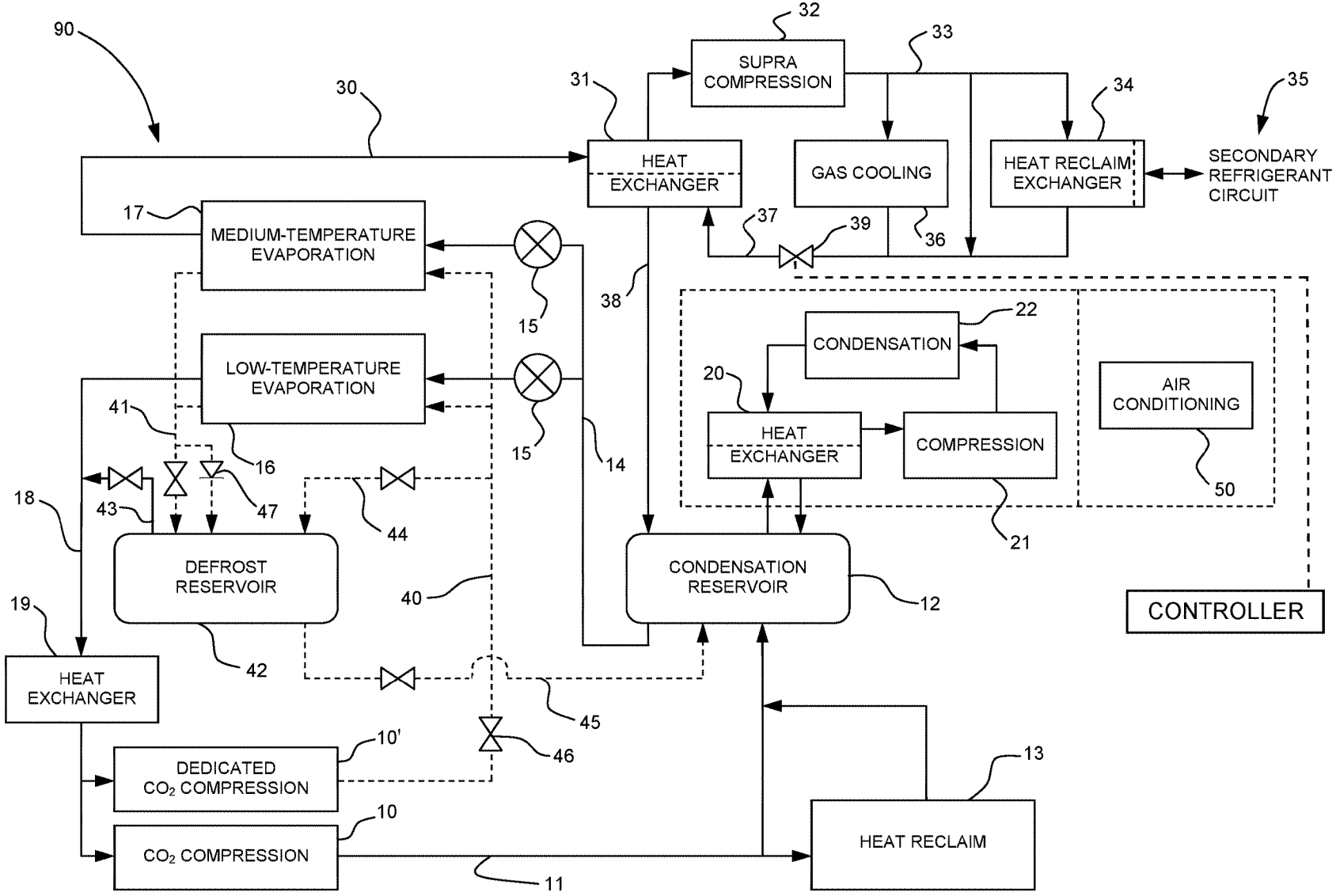
FIG. 7 is a block diagram of a $CO_2$ refrigeration system in accordance with another embodiment, with dedicated compression for defrost.

Referring to FIG. 7, yet another embodiment of a $CO_2$ refrigeration system is illustrated at 90. The $CO_2$ refrigeration systems 1 and 90 have numerous common stages and lines, whereby like elements will bear like reference numerals. One difference between the $CO_2$ refrigeration systems 1 and 90 is the presence of at least one dedicated compressor 10' to compress defrost refrigerant. The discharge of the dedicated compressor 10' goes at least partially to the defrost circuit, whereas the discharge of the other compressors 10 is directed to the refrigeration circuit. A line and valve (not shown) may be used to direct some excess refrigerant from the dedicated compressor 10' to the refrigeration circuit. The $CO_2$ dedicated compressor 10' may also be used to flush the defrost reservoir 42.

As an alternative, defrost could be made by directing refrigerant from the supra-compression circuit, into the defrost circuit, using an appropriate pressure-reducing valve.

Figure 8:
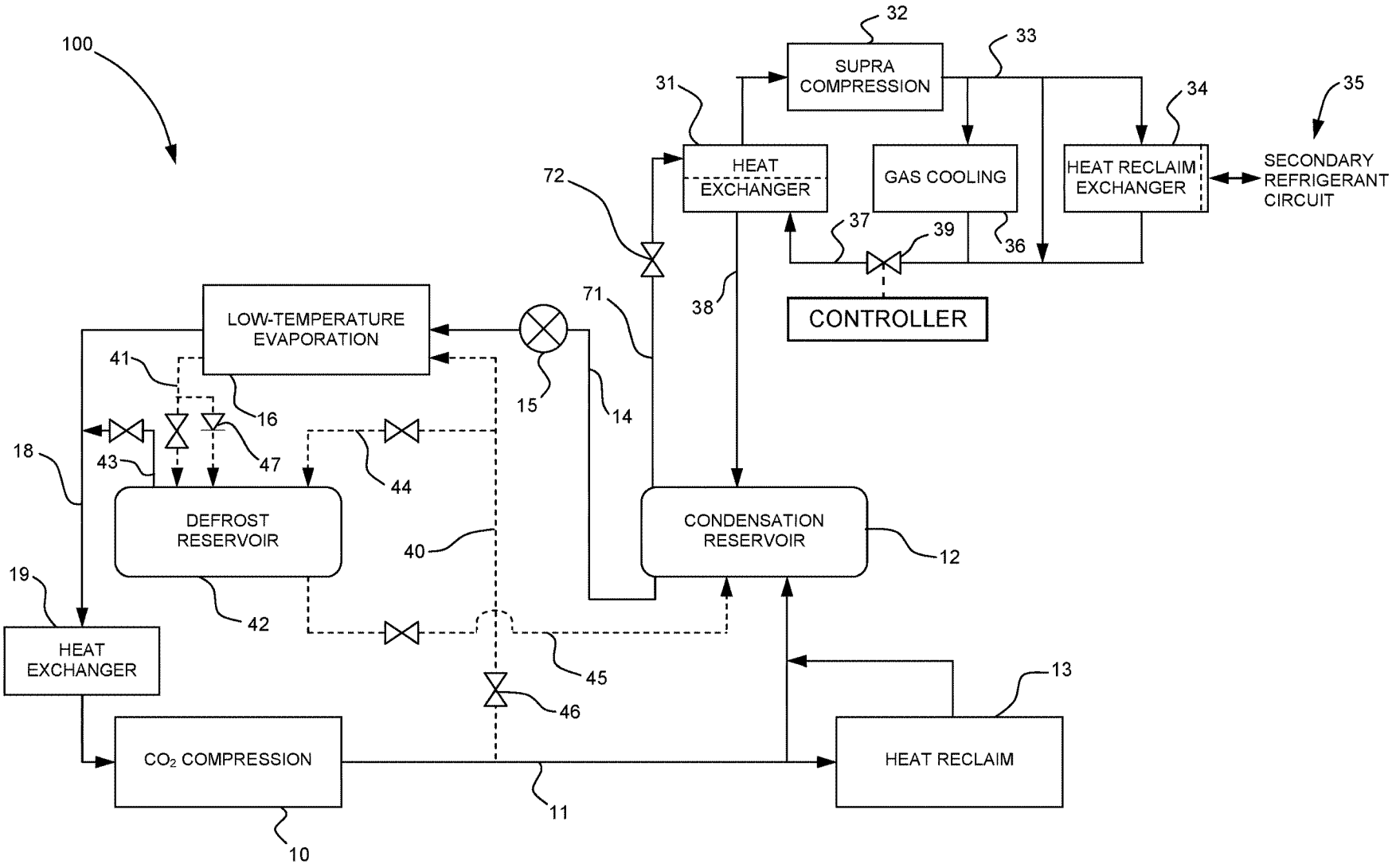
FIG. 8 is a block diagram of a $CO_2$ refrigeration system in accordance with another embodiment, e.g., for a skating rink application.

Referring to FIG. 8, yet another embodiment of a $CO_2$ refrigeration system is illustrated at 100. The $CO_2$ refrigeration systems 70 (FIG. 5) and 90 have numerous common stages and lines, whereby like elements will bear like reference numerals. The $CO_2$ refrigeration system 100 is well suited for applications requiring low-temperature cooling, such as ice-skating rinks and industrial freezer applications.

The $CO_2$ refrigeration system 100 may be configured to operate without the $CO_2$ compression stages, due to the heat removal capacity of the supra-compression circuit. In such a configuration, a pump may circulate the refrigerant in the refrigeration circuit, from the condensation reservoir 12 to the low-temperature evaporation 16. In the ice-skating rink applications, the various heat absorbing components (e.g., the heat reclaim stage 13, the heat reclaim exchanger 34) may be used to melt zamboni residue in an ice dump. It is preferred not to use the supra-compression circuit when the $CO_2$ refrigeration system 100 is operated in warmer countries. The $CO_2$ refrigeration system 100 is more efficient with $CO_2$ compression in such climates.

Considering the nature of the refrigerant, plastic tubing or non-rigid lines may be used as an alternative to the rigid metallic lines previously used, between the mechanical room and the stages of the systems, such as the condensation stage 12 and the evaporation stages 16 and 17. One known type of pipes that can be used is Halcor Cusmart pipes, and features a non-rigid copper core with a plastic insulation sleeve about the core. Such configurations are cost-efficient in that no weld joints are required to interconnect pipes, as is the case for rigid metallic lines. Gutters, for instance having a trapezoid cross-section, may be used as a guide for lines.

Figure 9:
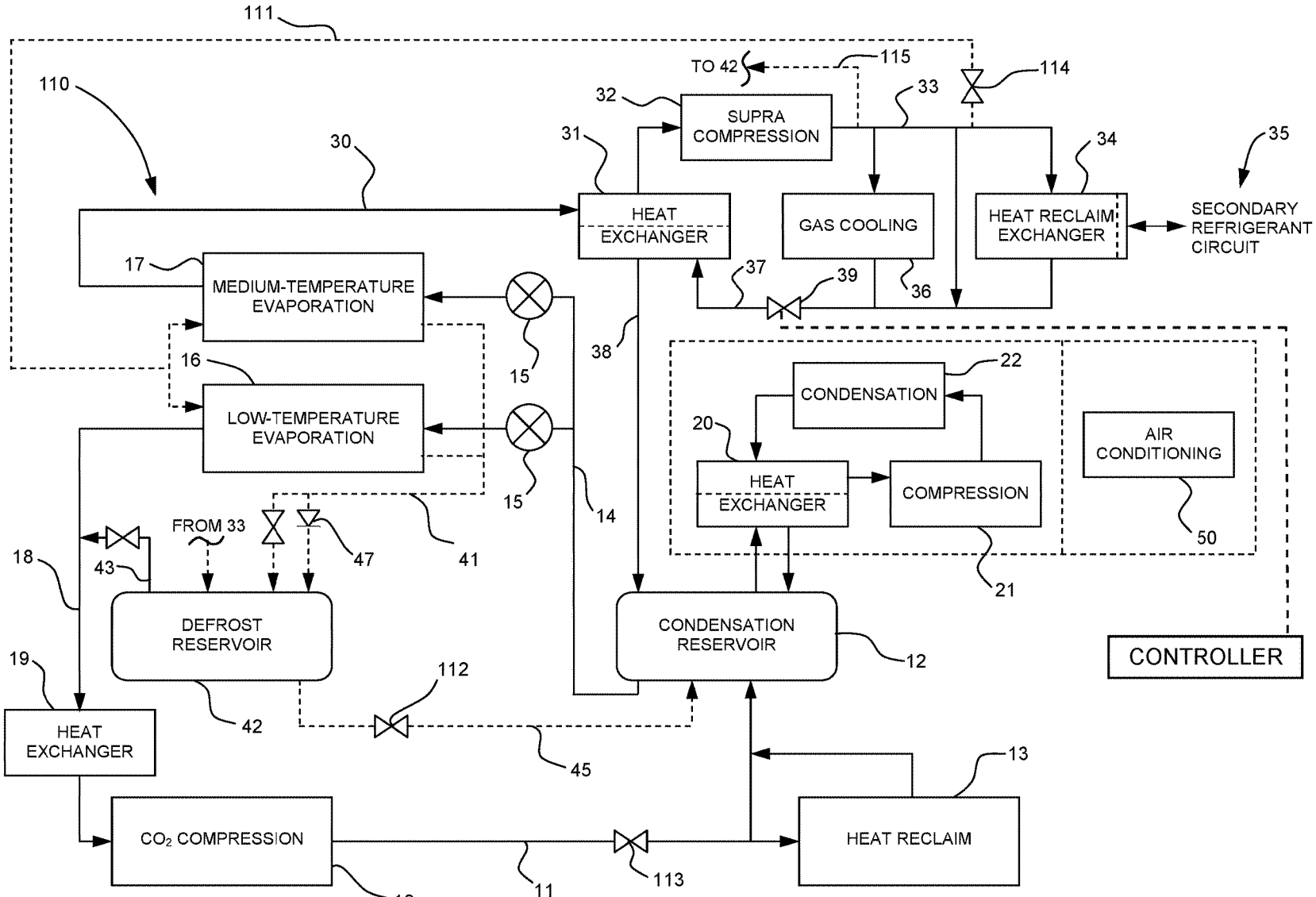
FIG. 9 is a block diagram of a $CO_2$ refrigeration system in accordance with another embodiment, with a supra-compression providing defrost.

Referring to FIG. 9, yet another embodiment of a $CO_2$ refrigeration system is illustrated at 110. The $CO_2$ refrigeration systems 1 and 110 have numerous common stages and lines, whereby like elements will bear like reference numerals. One difference between the $CO_2$ refrigeration systems 1 and 110 is line 111 directing $CO_2$ refrigerant from the supra-compression stage 32 to the evaporator stages 16 and 17 for defrost. Accordingly, the $CO_2$ refrigerant fed to the evaporation stage 16/17 is at a relatively high pressure—valve 114 may be provided to lower the pressure of the $CO_2$ refrigerant to an appropriate level (e.g., 500 Psi). The defrost refrigerant is then directed to the defrost reservoir 42. A valve 112 is provided to control the amount of defrost refrigerant from the reservoir 42 reintegrating the refrigeration cycle. Moreover, in order to maintain a suitable compression ratio in view of the operating pressure of the condensation reservoir 12, a pressure-reducing valve 113 is provided in the line 11, so as to reduce the pressure of the $CO_2$ refrigerant feeding the condensation reservoir 12.

Moreover, the refrigeration system 110 has a line 115 (with appropriate valves) selectively directing refrigerant from the supra-compression stage 32 to the defrost reservoir 42, to flush the reservoir 42 when required. It is pointed out that the heat exchangers 19 and 31 are optional, as is the condensation circuit featuring the compression stage 21.

Figure 10:
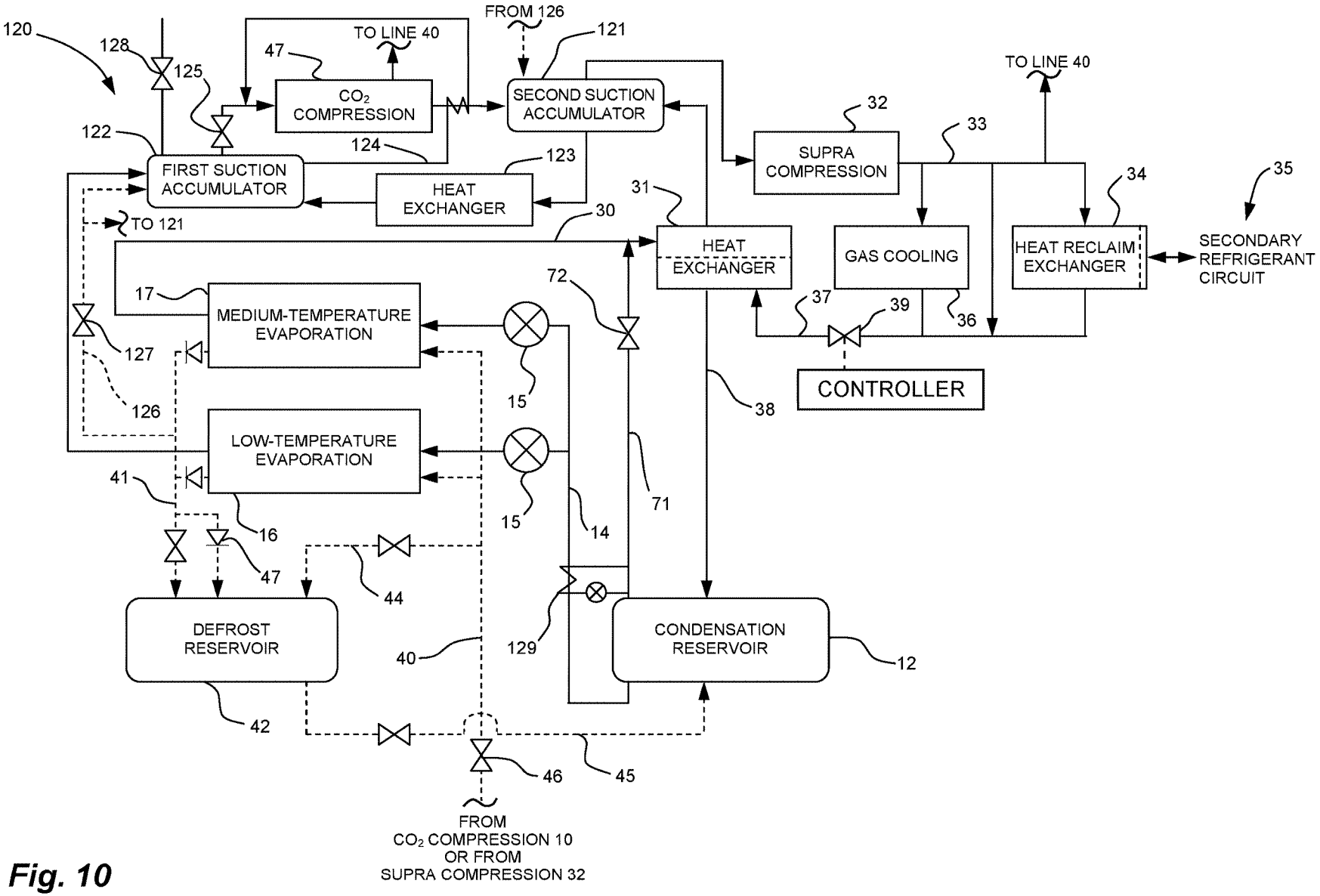
FIG. 10 is a block diagram of a $CO_2$ refrigeration system in accordance with another embodiment, with cascaded compression.

Referring to FIG. 10, yet another embodiment of a $CO_2$ refrigeration system is illustrated at 120. The $CO_2$ refrigeration systems 70 and 120 have numerous common stages and lines, whereby like elements will bear like reference numerals. The $CO_2$ refrigeration system 120 has a cascaded arrangement for the two stages of $CO_2$ compression, namely compression stage 10 and supra-compression stage 32. More specifically, the refrigerant discharge from the compression stage 10 is fed to a suction accumulator 121, and $CO_2$ refrigerant in a gas state is sucked from a top of the accumulator 121 by the supra-compression stage 32.

The suction accumulator 121 also receives $CO_2$ refrigerant from the evaporation stage 17, optionally via heat exchanger 31. Gas $CO_2$ refrigerant from the condensation reservoir 12 may also be directed to the suction accumulator 121. The liquid $CO_2$ refrigerant from the suction accumulator 121 may be directed to the compression stage 10.

In order to maintain suitable conditions for the refrigerant at the inlet of the compression stage, a first suction accumulator 122 is provided downstream of the compression stage 10, which suction accumulator 122 receives $CO_2$ refrigerant from the suction accumulator 121 through a line (e.g., capillary) having a heat exchanger 123 for heat exchange with a discharge of the supracompression stage 32, or with a discharge of the compression stage 10. Moreover, liquid refrigerant from the suction accumulator 122 may be heated by line 124, in heat exchange with the discharge of the compression stage 10 or with supracompression stage 32, or simply by using an electric heater. The line 124 may then direct the vaporized refrigerant to the suction of the compression stage 10. In an embodiment, the line 124 collects liquid $CO_2$ refrigerant and oil at a bottom of the suction accumulator 122. Accordingly, the vaporized refrigerant has an oil content when fed to the compressors of the compression stage 10. The oil is then recuperated for instance in the suction accumulator 121. A similar loop may be performed to feed a mixture of $CO_2$ refrigerant and oil to the supra-compression stage 32.

In the embodiment in which the line 124 directs vaporized refrigerant to the suction of the compression stage 10, a valve 125 is provided in that case to maintain a pressure differential between the suction accumulator 122 and the suction of the compression stage 10, to allow the flow of refrigerant from line 124 into $CO_2$ compression stage 10. It is considered to use other components than suction accumulator 121, suction accumulator 122, line 124 and heat exchanger 123 to vaporize the refrigerant, such as a heating element, an air conditioning system, a heat exchanger and the like. It is also considered that $CO_2$ refrigerant leaving suction accumulator 121 and suction accumulator 122 be directed elsewhere in the $CO_2$ refrigeration system.

The cascaded compressor configuration of FIG. 10 is well suited to preserve the oil in the compression stage 10. More specifically, oil accumulating in the suction accumulator 121 is returned to the suction accumulator 122 via the line of heat-exchanger 123. The oil may then be sucked with refrigerant by the compression stage 10. Accordingly, the oil cycles between stages 10, 121 and 122. A similar cycle may be used for feeding an oil and refrigerant mixture to the supra-compression stage 32.

The defrost of the evaporation stages 16 and 17 may be performed at low pressure so as to avoid damaging the evaporator coils. Accordingly, the refrigeration cycle 120 may be retrofitted to existing evaporator coils, considering the relatively low defrost pressures. The defrost $CO_2$ refrigerant may be fed by the compression stage 10, or by the supra compression stage 32, with valve 46 controlling the pressure.

In order to protect the evaporator coils from high defrost pressures, a set of lines 126 extends from the evaporator coils to any reservoir or accumulator of the refrigeration system 120. For instance, the lines 126 are connected to one of the accumulators 121 and 122 while being separated by a valve 127. The valve 127 opens if the pressure in the evaporator coils is above a given threshold. Accordingly, if the defrost pressure in the evaporator coils is too high, the defrost $CO_2$ refrigerant is discharged to one of the accumulators 121 and 122, whereby the $CO_2$ refrigerant stays in the refrigeration system 120. As another safety measure, a pressure-relief valve system 128 is provided on the appropriate accumulators, such as 122 as shown but alternatively on the accumulator 121 or on the condensation reservoir 12.

For instance, the method for relieving $CO_2$ refrigerant pressure from evaporators during a defrost cycle comprises providing a pressure-relief valve for each evaporator line, the pressure relief-valve opening at a pressure threshold.

$CO_2$ refrigerant is then fed to evaporators in the evaporator line to defrost the evaporator. The evaporators are exhausted from the $CO_2$ refrigerant with the pressure-relief valve when the $CO_2$ refrigerant pressure is above the pressure threshold; and directing the exhausted $CO_2$ refrigerant to an accumulator in a refrigeration cycle.

In specific conditions, it may be required to cool the $CO_2$ refrigerant fed to the evaporation stages 16 and/or 17 during the refrigeration cycle. Accordingly, a heat-exchanger system 129, for instance with an expansion valve, may direct refrigerant from the line 71 and feed same to the heat-exchanger system 129, to cool the $CO_2$ refrigerant fed to the evaporation stages 16 and/or 17.

The valve 39 is controlled (e.g., modulated) to maximize the heat reclaim via the heat reclaim exchanger 34. When the heat demand is high (e.g., during Winter in colder climates), the valve 39 may maintain a high refrigerant pressure downstream of the compression stage 32, to ensure the heat reclaim exchanger 34 extracts as much heat as possible from the $CO_2$ refrigerant. The amount of refrigerant sent to the gas cooling stage 36 is controlled simultaneously.

Figure 11:
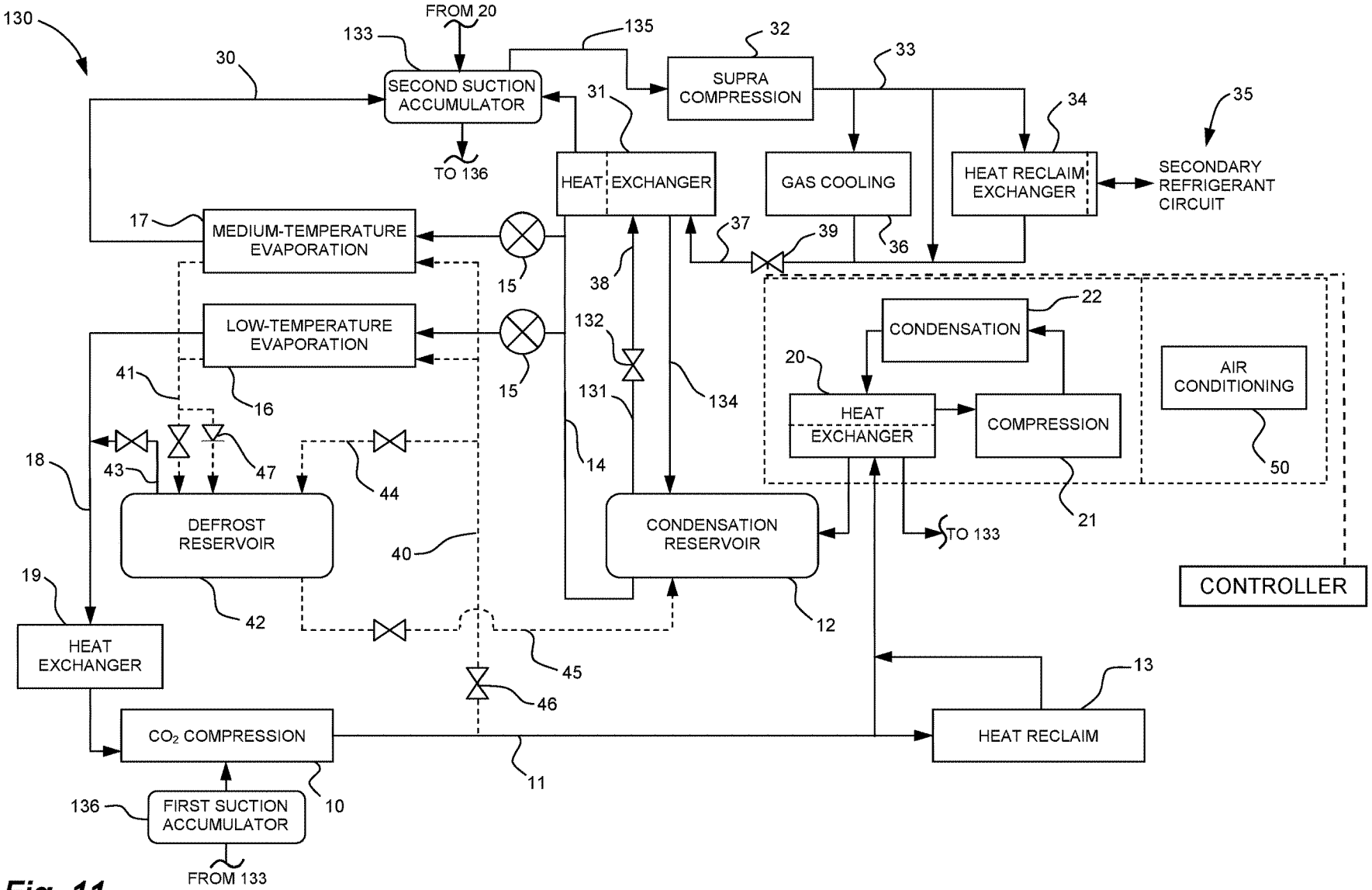
FIG. 11 is a block diagram of a $CO_2$ refrigeration system in accordance with another embodiment, with suction accumulation upstream of a supra-compression stage.

Referring to FIG. 11, yet another embodiment of a $CO_2$ refrigeration system is illustrated at 130. The $CO_2$ refrigeration systems 1 and 130 have numerous common stages and lines, whereby like elements will bear like reference numerals. The $CO_2$ refrigeration system 130 is particularly well suited for hot climate applications. In the $CO_2$ refrigeration system 130, the discharge of the compression stage 10 is directed to the heat exchanger 20 prior to reaching the condensation reservoir 12, for relatively low pressure condensation. Alternatively, the refrigerant exiting the heat exchanger 20 may be directed to the suction accumulator 133, thereby bypassing the condensation reservoir 12. A gaseous portion of the $CO_2$ refrigerant in the condensation reservoir 12 is directed via line 131 and pressure-reducing valve 132 into the heat exchanger 31 to reach the suction accumulator 133. The $CO_2$ refrigerant passing through the heat exchanger 31 absorbs heat from the $CO_2$ refrigerant exiting the supra-compression circuit via line 134. A line 135 relates a top of the suction accumulator 133 to the supra-compression stage 32, to feed gaseous $CO_2$ refrigerant to the compressors. Liquid $CO_2$ refrigerant may be directed to another suction accumulator 136, at the suction of the compression stage 10, in similar fashion to the $CO_2$ refrigeration system 120 of FIG. 10 (with appropriate heat exchange with the discharge of stage 10 if necessary). The supra-compression circuit is typically used to reclaim heat, while the evaporation stages 16 and 17 are part of a HVAC unit, amongst other possibilities.

Figure 12:
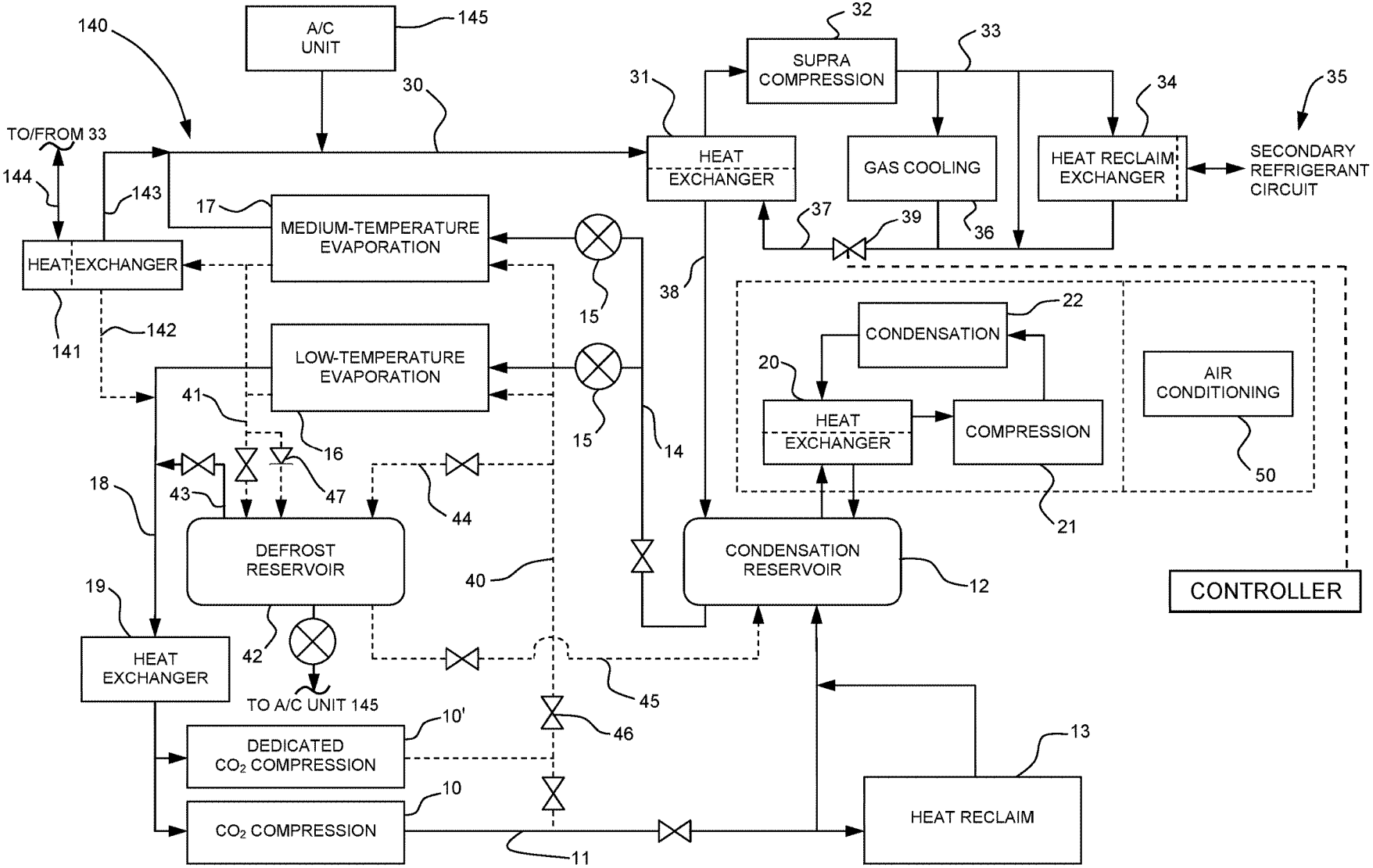
FIG. 12 is a block diagram of a $CO_2$ refrigeration system in accordance with another embodiment, with a heat-exchanger for defrost refrigerant.

Referring to FIG. 12, yet another embodiment of a $CO_2$ refrigeration system is illustrated at 140. The $CO_2$ refrigeration systems 1 and 140 have numerous common stages and lines, whereby like elements will bear like reference numerals. The $CO_2$ refrigeration system 140 has a heat exchanger 141 collecting defrost $CO_2$ refrigerant at the outlet of the evaporators 16/17, to vaporize the defrost $CO_2$ refrigerant and return same into the refrigeration cycle, namely to feed the suction of the compression stage 10 via line 142 or the supra-compression stage 32 via line 143. The heat exchanger 141 allows heat exchange between the defrost $CO_2$ refrigerant and the $CO_2$ refrigerant exiting the supra-compression stage 32 via lines 144, and may also be any other heat source (e.g. electric heater, heat reclaim, air-conditioning unit, or the like).

An air-conditioning unit 145 may be in fluid communication with the defrost reservoir 42 so as to use the defrost $CO_2$ refrigerant accumulated therein for air-conditioning purposes. The discharge of the air-conditioning unit 145 may be returned to the suction of the supra-compression stage 32, amongst other possibilities. In the various refrigerant systems described above, it is pointed out that the defrost refrigerant may be fed to the evaporators of stages 16 and 17 from either direction (as opposed to being fed in a direction opposed to that of refrigerant in the refrigeration cycle). Moreover, it is considered to provide the valves controlling the flow of defrost refrigerant to the evaporators 16 and 17 in the refrigeration pack, and have a plurality of lines for each single valve.

Figure 13:
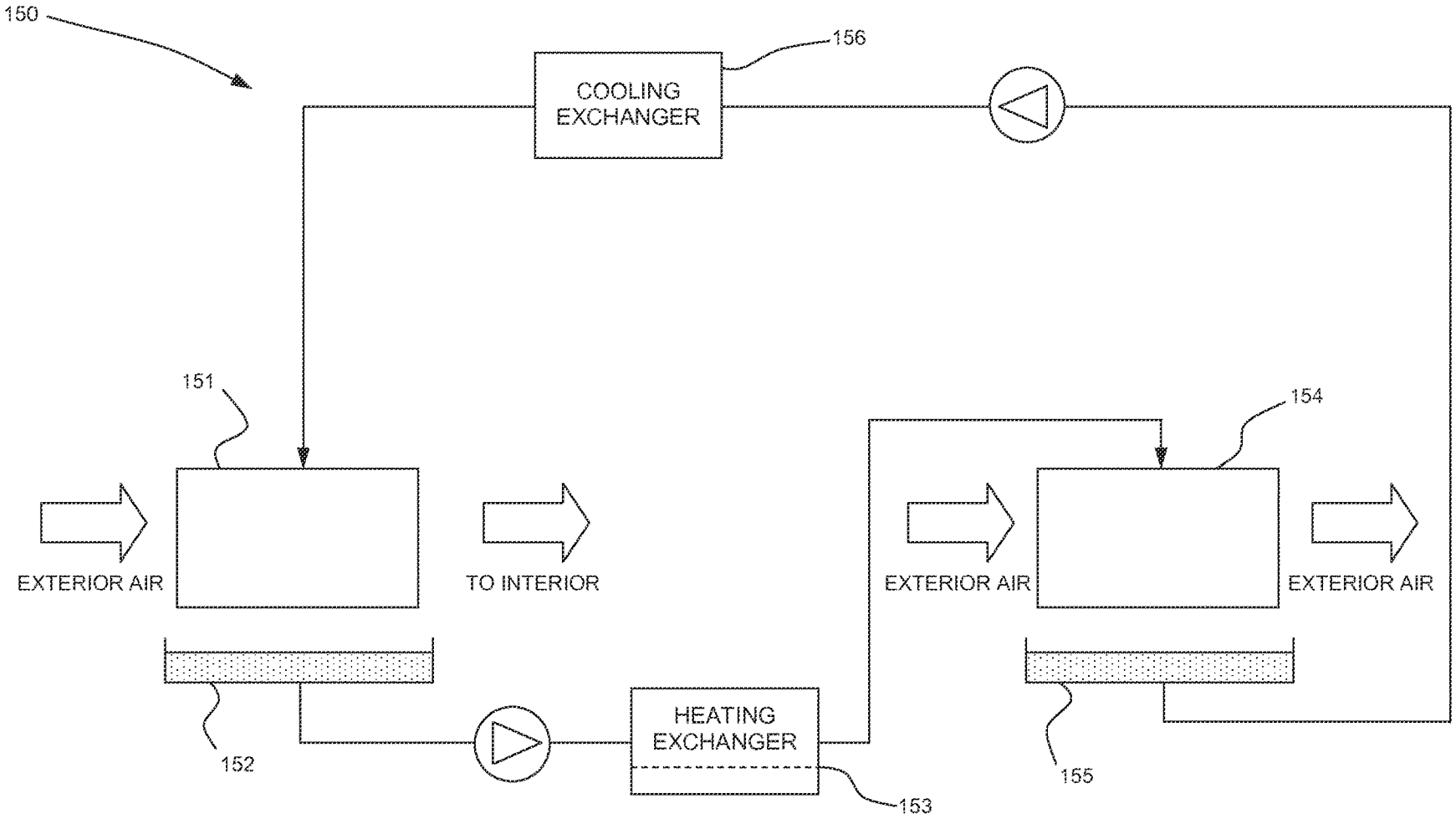
FIG. 13 is a schematic view of a desiccant system in accordance with another embodiment of the present application.

Referring to FIG. 13, a desiccant system is generally shown at 150. The desiccant system 150 may be used with any of the refrigeration systems described above, or with other refrigeration systems, to dry air being entered into a building for ventilating or refrigerating purposes. The desiccant system 150 is a closed circuit in which circulates a desiccant fluid.

The system 150 has a dryer 151, upon which exterior air flows when entering the building. The dryer 151 is a structural device upon which the desiccant fluid is sprayed. For instance, the dryer 151 may provide a honeycomb body. The desiccant fluid sprayed on the dryer 151 is in a suitable cooled state to absorb humidity from the warm exterior air entering the building. The desiccant fluid reaches a substantially liquid state after the absorption of humidity, and drips into pan 152 (or any other collector).

By way of a line and pump, the desiccant fluid passes through a heating exchanger 153 to be heated. Although not shown, the heating exchanger 153 may be connected to one of the above-referred refrigeration circuits, so as to provide the necessary energy to heat the desiccant fluid. Alternatively, the heating exchanger 153 may have an electric coil or the like.

The desiccant fluid, in a heated state, is then sprayed onto a humidifier 154. The humidifier 154 is similar to the dryer 151 in construction, but releases water to the exterior air. The desiccant fluid is heated as a function of the exterior temperature, for the desiccant fluid to release the previously-absorbed water to the air. The liquid desiccant is then collected in another pan 155 (or the like).

By way of a line and pump, the desiccant fluid passes through a cooling exchanger 156 to be cooled. Although not shown, the cooling exchanger 156 may be connected to one of the above-referred refrigeration circuits, so as to provide the necessary energy to cool the desiccant fluid. The desiccant fluid is cooled as a function of the exterior temperature, for the desiccant to absorb water from the outdoor air entering the building. Once it is cooled, the desiccant fluid is directed to the dryer 151.

The invention claimed is:

1. A $CO_2$ refrigeration system for an ice-playing surface, comprising:

- a compression stage in which $CO_2$ refrigerant is compressed and an evaporation stage in which heat is absorbed from the ice-playing surface;
- a plurality of $CO_2$ compressors in the compression stage for compressing the $CO_2$ refrigerant subcritically and transcritically;
- a gas cooling stage includes at least a plurality of heat-reclaim units reclaiming heat from the $CO_2$ refrigerant compressed in the compression stage;
- a pressure-regulating device downstream of the gas cooling stage, the pressure-regulating device operable to control a pressure of the $CO_2$ refrigerant in the gas cooling stage as a function of a heat demand of the plurality of heat-reclaim units; and a reservoir downstream of the pressure-regulating device for receiving the $CO_2$ refrigerant in a liquid state, a controller operating the pressure-regulating device to control the pressure of the $CO_2$ refrigerant in the gas cooling stage as a function of the heat demand of the plurality of heat-reclaim units, the controller, via its operating of the pressure-regulating device, causing the pressure of the $CO_2$ refrigerant to reach a transcritical level as a function of a heat demand of the plurality of heat-reclaim units.

2. The $CO_2$ refrigeration system according to claim 1, wherein the evaporation stage of the $CO_2$ refrigeration system receives the $CO_2$ refrigerant from the reservoir of the $CO_2$ refrigeration system and has a circuit of pipes arranged under the ice-playing surface, whereby the $CO_2$ refrigerant circulates in the circuit of pipes to absorb heat from the ice-playing surface.

3. The $CO_2$ refrigeration system according to claim 1, further comprising a secondary refrigerant circuit in which circulates a secondary refrigerant, and wherein at least one of the heat-reclaim units has at least one heat-reclaim exchanger related to the secondary refrigerant circuit, the at least one heat-reclaim exchanger causing the $CO_2$ refrigerant to release heat to the secondary refrigerant.

4. The $CO_2$ refrigeration system according to claim 3, further comprising at least one water tank in the secondary refrigerant circuit, with the at least one water tank comprising a heat exchanger in which circulates the secondary refrigerant to heat water in the water tank.

5. The $CO_2$ refrigeration system according to claim 3, wherein the secondary refrigerant circuit further comprises at least one water tank, with the at least one water tank comprising a heat exchanger in which circulates the $CO_2$ refrigerant to heat water in the water tank.

6. The $CO_2$ refrigeration system according to claim 1, wherein a portion of the heat-reclaim units are in a parallel arrangement.

7. The $CO_2$ refrigeration system according to claim 1, wherein a portion of the heat-reclaim units are in a series arrangement.

8. The $CO_2$ refrigeration system according to claim 2, further comprising at least one expansion valve to vaporize the $CO_2$ refrigerant fed to the circuit of pipes.

9. The $CO_2$ refrigeration system according to claim 1, further comprising at least one pump downstream of the reservoir to direct liquid $CO_2$ refrigerant to the evaporation stage.

10. The $CO_2$ refrigeration system according to claim 1, wherein at least one of the heat-reclaim units comprises at least one fan blowing air on a coil in which circulates the $CO_2$ refrigerant.

11. The $CO_2$ refrigeration system according to claim 1, further comprising an oil circuit in the $CO_2$ refrigeration system, the oil circuit collecting oil downstream of at least one of the compressors in the compression stage, the oil circuit directing the oil upstream of the compressors for the $CO_2$ refrigerant fed to said compressor to have an oil content.

12. The $CO_2$ refrigeration system according to claim 11, wherein the oil circuit is connected to a bottom of the reservoir to collect the oil.

13. The $CO_2$ refrigeration system according to claim 12, further comprising an accumulator upstream of the compressors, the oil circuit directing the oil from the reservoir to the accumulator, a suction line extending from the accumulator to at least one of the compressors for directing the $CO_2$ refrigerant with oil content to said compressor.

14. The $CO_2$ refrigeration system according to claim 13, further comprising a heat exchanger in the suction line to vaporize the $CO_2$ refrigerant with oil content, the suction line collecting liquid $CO_2$ refrigerant with oil content from a bottom of the accumulator.

15. The $CO_2$ refrigeration system according to claim 1, wherein the pressure-regulating device is a modulating valve controlled to maximize the heat reclaim as a function of the heat demand of the plurality of heat-reclaim units.

16. The $CO_2$ refrigeration system according to claim 1, wherein the controller, via its operating of the pressure-regulating device, causes the pressure of the $CO_2$ refrigerant to reach a pressure of at least 1400 Psi as a function of the heat demand during a winter month period, the controller, via its operating of the pressure-regulating device, causing the pressure of the $CO_2$ refrigerant to reach a pressure including 550 Psi as a function of the heat demand during a summer month period, wherein an outdoor temperature is warmer in the summer month period than in the winter month period.

* * * * *